US005345646A

United States Patent [19]

Rothweiler

[11] Patent Number: 5,345,646

[45] Date of Patent: Sep. 13, 1994

[54] HANDBRUSH FOR CLEANING PROTHESES, PARTICULARLY TOOTH PROSTHESES

[75] Inventor: Emil Rothweiler, Hechingen, Fed. Rep. of Germany

[73] Assignee: Gebr. Rothweiler GmbH & Co. KG, Hechingen, Fed. Rep. of Germany

[21] Appl. No.: 67,224

[22] Filed: May 26, 1993

[30] Foreign Application Priority Data

May 26, 1992 [DE] Fed. Rep. of Germany ... 9207075[U]

[51] Int. Cl.[5] ..... A46B 9/04

[52] U.S. Cl. ..... 15/167.1; 15/187

[58] Field of Search ..... 15/167.1, 176.1, 176.4–176.6, 15/186–188, 202; 119/86, 94; 132/107, 150, 152, 155

[56] References Cited

U.S. PATENT DOCUMENTS

| | | | |
|---|---|---|---|
| 1,765,623 | 6/1930 | Schweibold | 15/187 |
| 2,795,807 | 6/1957 | Salvy | 15/187 |
| 2,920,334 | 1/1960 | Keller | 15/187 |
| 4,423,531 | 1/1984 | Wall | 15/187 |
| 4,500,939 | 2/1985 | Gueret | 15/187 |

FOREIGN PATENT DOCUMENTS

| | | | |
|---|---|---|---|
| 14160 | 9/1955 | Fed. Rep. of Germany | 15/187 |
| 939685 | 3/1956 | Fed. Rep. of Germany | 15/187 |
| 1048262 | 1/1959 | Fed. Rep. of Germany | 15/187 |
| 1072436 | 3/1954 | France | 15/187 |
| 2358125 | 3/1978 | France | 15/187 |
| 2473287 | 7/1981 | France | 15/186 |
| 425524 | 10/1949 | Italy | 15/186 |
| 196815 | 6/1938 | Switzerland | 15/188 |
| 804331 | 11/1958 | United Kingdom | 15/187 |
| 943590 | 12/1963 | United Kingdom | 15/176.6 |

*Primary Examiner*—Timothy F. Simone
*Assistant Examiner*—Mark Spisich
*Attorney, Agent, or Firm*—Michael J. Striker

[57] ABSTRACT

A handbrush for cleaning prostheses, in particular tooth prostheses, has a bristle support provided with a plurality of bristles and a hand gripping part connected with the bristle support. The bristle support, the bristles and the hand gripping part are recyclable as a whole and composed of sterilizable and food strap suitable synthetic plastic materials. The bristles being formed of one piece with the bristle support which has a large surface, and the bristle support is nonreleasably connected with the hand gripping part by an arresting connection.

9 Claims, 3 Drawing Sheets

HANDBRUSH FOR CLEANING PROTHESES, PARTICULARLY TOOTH PROSTHESES

BACKGROUND OF THE INVENTION

The present invention relates to handbrushes for cleaning of prosthesis, in particular tooth prosthesis, with a bristle holder connected with a hand-gripping part.

The known handbrushes for cleaning of prostheses are formed predominantly as handle brushes. This is also true for brushes for cleaning of tooth prostheses, which are formed as tooth brushes and have a relatively small bristle surface. For tooth prostheses carriers which are predominantly old people a difficult handling of known tooth prosthesis brushes is disadvantageous. From a medical side, it is required that the brush for cleaning a prosthesis be designed hygienically.

SUMMARY OF THE INVENTION

Accordingly, it is an object of the present invention to provide a handbrush for cleaning of prostheses, in particular tooth prostheses, which can be easily and reliably handled and also completely corresponds to hygienic requirements.

In keeping with these objects and with others which will become apparent hereinafter, one feature of the present invention recites, briefly stated, in handbrush which is recyclable and sterilizable as a whole and composed of food stuff-suitable synthetic plastic material, wherein the elastic bristles are formed of one piece with a bristle support having a large surface, and the bristle support is connected with the handle gripping part not releasable by means of an arresting connection.

The handbrush in accordance with the present invention is composed of the same synthetic material in all its parts, so that old brushes can be supplied as a whole to a processing device. In addition to this environmental protection aspect, the handbrush in accordance with the present invention has an important hygienic advantage. Due to the one piece formation of the bristles with a bristle support no openings in the bristle support for mounting of bristles are needed, in which dirt and bacteria can settle. The bristles and the bristle support can be produced as a one-piece injection molding part composed of a food stuff-suitable soft plastic material with any softness and boilable and sterilizable. For the hand gripping part and the arresting connection, similar synthetic plastic material can be utilized so that the brush as a whole is boilable. The large bristle surface in connection with well engageable hand gripping part which is preferably concentric and/or symmetrical to a symmetry axis or symmetry plane of the bristle part, ensures an easy and reliable handling of the handbrush by all people. The bristle support can be connected with the handle gripping part by means of an arresting coupling part or indirectly and nonreleasable arresting fashion.

Advantageously, the bristles are thin and pointy and molded on the plate-shaped bristle support. Preferably, the plate-shaped bristle support has an edge web on its rear side facing away from the bristles, which is undercut to a ring groove for the formed-locking receipt of the plate-shaped end of the arresting coupling part or the handle griping part.

For an easy and reliable, and reusable connection of the specially produced hand gripping part with the bristle support by means of an arresting coupling part, the plate-shaped end of the arresting coupling part is subdivided into two halves, each turnable along a diametrical line relative to one another. The halves are provided with perpendicularly expanding coupling web halves formed so that when the plate halves coincide with one another, the coupling web halves are located opposite to one another and are provided on their outer side with arresting projections or arresting recesses. When the coupling web is inserted through a passing opening of the handle gripping part, the arresting projections or arresting recesses cooperate with arresting recesses for arresting projections formed on the inner side of the hand gripping part in a form-locking manner.

By turning of one of the plate halves, the plate-shaped end of the arresting coupling part is placed relative to the near side of the bristle support so that the plate halves can be formed-lockingly inserted in the ring groove of the edge web of the brush body. Then the coupling web of the arresting coupling part is inserted into the passing opening of the gripping part in which it is not releasably arrested and its both halves are thereby locked from releasing at their opposite-side abutment.

When an arresting coupling part between the bristle support and the hand gripping part is dispensed with, the latter can be subdivided into two oppositely turnable halves which are provided on their inner sides with arresting knobs and corresponding recesses for opposite connection. Also, in this embodiment by turning of both gripping part halves a plate edge formed on them engages in a corresponding arresting groove on the bristle support before the halves are finally nonreleasably, arrestably connected with one another. A reliable sealing of the abutment surfaces within the bristle support and the gripping part can be easily obtained when the opening edge of the hand gripping part and/or the edge web of the bristle support are provided with an outer sealing bead or sealing lip formed on it.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

A handbrush and in accordance with the invention has a hand gripping part 11 and bristle support 12 which are formed as the molded parts of synthetic plastic materials. The molded parts are metal free and therefore are food stuff-suitable, boilable and sterilizable. The hand gripping part 11 has an elongated spherical rear portion 11.1 and a gripping trough 11.2 expanding in directions towards the bristle support 12. The hand gripping part 11 is symmetrical relative to a plane of symmetry of the bristle support 12, which is identified with a section line II—II. The bristle support 12 is formed as a plate which for example has a circular shape.

Figure 1:
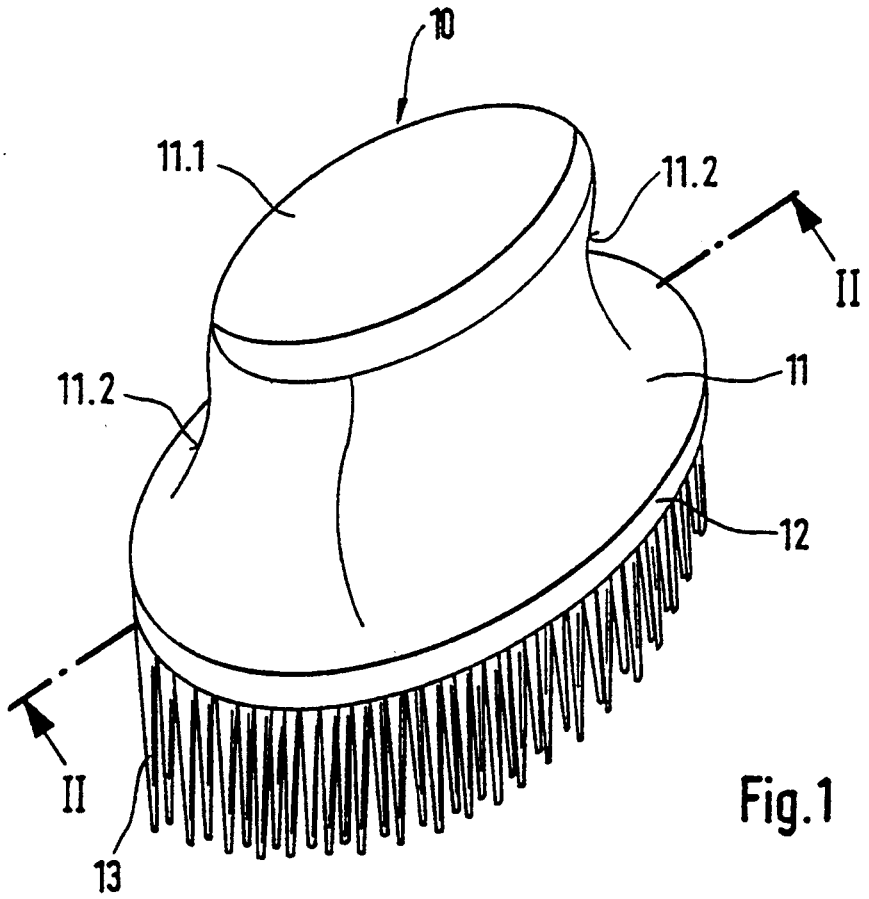
FIG. 1 is a schematic perspective view of the handbrush in accordance with the first embodiment of the invention.
Figure 2:
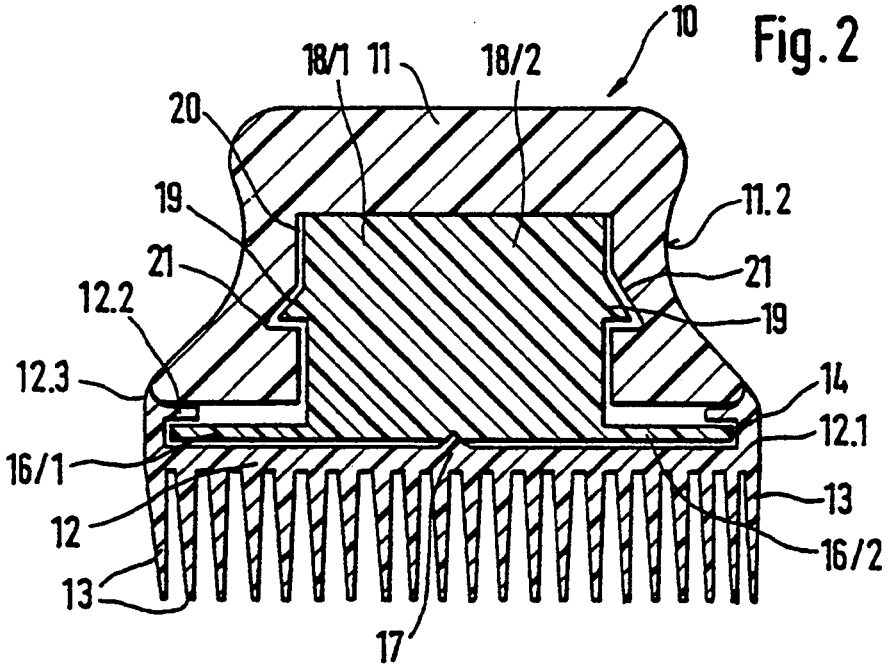
FIG. 2 is a view showing a central section through the handbrush, taken along the line II—II in FIG. 1.

As shown on the section of FIG. 2, the pointed bristles 13 are directly formed (molded) on one side of the plate-shaped bristle 12. The bristle support 12 and the bristles 13 are produced of one piece with one another from a soft plastic material.

The plate-shaped bristle support 12 has a rear side provided with an edge web 12.1. The end region 12.2 of the edge web 12.1 is bent inwardly, so that the edge web 12.1–12.2 limits a ring groove 14. The inwardly bent edge region 12.2 of the edge web 12.1 forms an abutment surface for the hand gripping part 11 and it is formed in this region with an elastic sealing bead 12.3. The sealing bead prevents penetration of liquid into the interior of the handbrush 10. It can be also formed on the hand gripping part 11.

Figure 3:
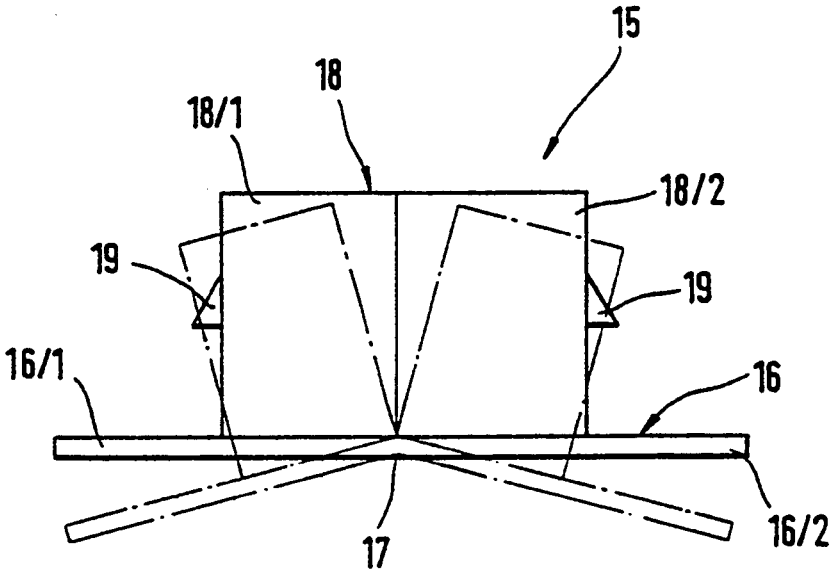
FIG. 3 is a view of an arresting coupling part of the handbrush of FIG. 1.

Another nonreleasable connection of the hand gripping part 11 with the bristle support 12 is provided by an arresting coupling part 15 which is shown in FIG. 3 in detail on a side view. The arresting coupling part 15 is composed of a plate 16 with sizes corresponding to the plate-shaped bristle support 12, so that the plate shown in FIG. 2 at least with the greatest part of its outer edge passes into the ring groove 14 formed on the bristle support 12. The plate 16 is subdivided into two halves 16/1 and 16/2 which are articulately connected to one another, by a notch 17 extending along the diametrical line. This subdivision is made also on a coupling web 18 which projects at one side of the plate 16, along the plane extending through the notch 17. The halves of the coupling web 18 are identified with 18/1 and 18/2. On opposite outer sides, the coupling web halves 18/1 and 18/2 are provided with a projecting arresting web 19.

When the plate halves 16/1 and 16/2 are in alignment with one another in their common plate plane, both couplings web halves 18/1 and 18/2 are located opposite to one another. In this operative position both plate halves 16/1 and 16/2 with their coupling web halves 18/1 and 18/2 are turned to an angular position identified with a broken line in FIG. 3. In this angular position both plate halves 16/1 and 16/2 can be inserted with their edges into the ring groove 14 of the brush support 12 and finally brought to their aligning position in which both coupling web halves 18/1 and 18/2 are located opposite to one another. In this position the coupling web 18 can be inserted into a matching opening 20 which opens to the lower side of the hand griping part 11. The side walls of the recess are provided with arresting recesses 21, in which the arresting projection 19 of the coupling web halves 18/1 and 18/2 can engage for providing a nonreleasable connection of the hand gripping part 11 and the bristle support 12. The synthetic plastic material which is utilized or produced in the arresting coupling part 15 and the hand gripping part 11 has a sufficient elasticity which provides a sufficient elastic deformation of these parts during the formation of the arresting connection.

Figure 4:
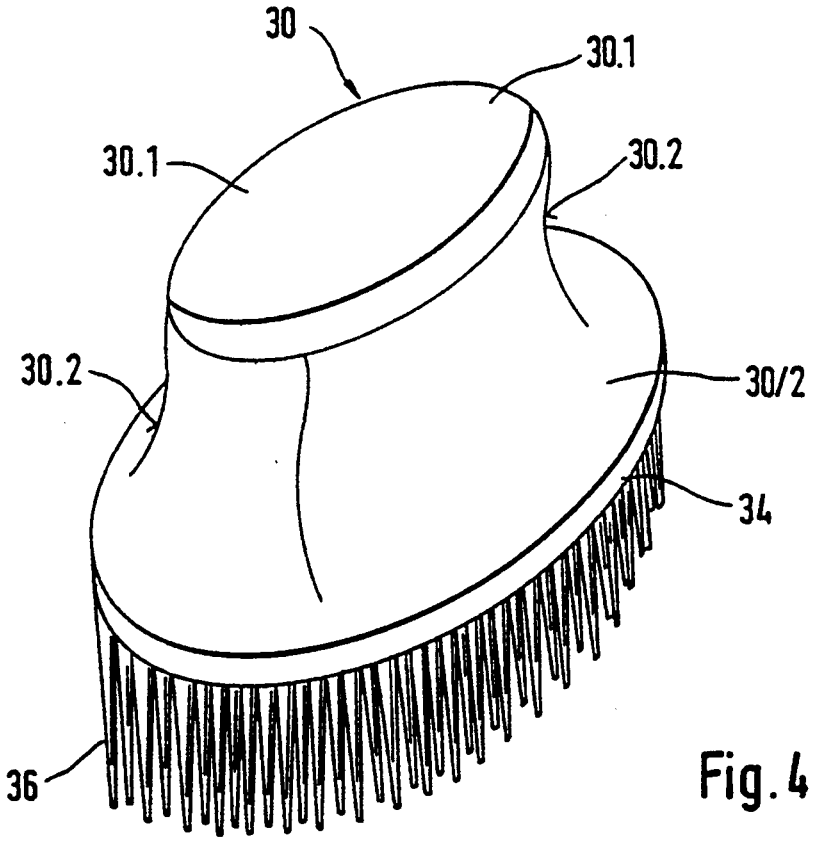
FIG. 4 is a schematic perspective view of a handbrush in accordance with a second embodiment of the invention.
Figure 5:
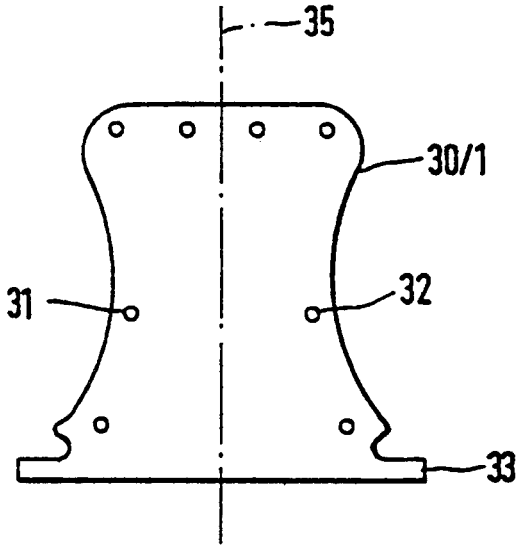
FIG. 5 is an inner view of a gripping part halves of the handbrush in accordance with FIG. 4.

FIG. 4 shows a handbrush with a hand gripping part 30 formed of two halves 30/1 and 30/2. As can be seen from FIG. 5, both halves 30/1 and 30/2 have a plate-shaped edge 33 which similarly to the edge 16 of the arresting coupling part 15 in FIG. 3, can be inserted into a corresponding not shown ring groove of the bristle support 34. For this purpose both gripping halves 30/1 and 30/2 similarly to the halves of the arresting coupling part 15 are turned, inserted into the annular groove of the bristle support 34, and then compressed. Therefore, arresting knobs 31 formed on the inner side of the halves 30/1 and 30/2 are form-lockingly engaged in the recesses 32 arranged on the inner side of the halves 30/1 and 30/2. Thereby a nonreleasable connection of the bristle support 34 with the gripping part 30 is produced. Both halves 30/1 and 30/2 are designed completely identically, or in other words they have the knobs on one side of their longitudinal symmetry axis 35 and the recesses 32 on the other side. In this manner both two halves 30/1 and 30/2 always match with one another. The production of differently shaped left and right halves is dispersed with.

It will be understood that each of the elements described above, or two or more together, may also find a useful application in other types of constructions differing from the types described above.

While the invention has been illustrated and described as embodied in Handbrush for Cleaning Prostheses, particularly Tooth Prostheses, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A handbrush for cleaning a prosthesis, comprising a bristle support provided with a plurality of bristles projecting from a first surface thereof; a hand gripping part connected to said bristle support; said bristle support, said bristles and said hand gripping part being recyclable as a whole and composed of sterilizable and food-stuff suitable synthetic plastic materials; said bristles being integrally formed with said bristle support; an arresting coupling part which releasably connects said bristle support with said hand gripping part, said arresting coupling part having a plate-shaped end which is subdivided into two plate halves turnable relative to one another about a notch formed in said arresting coupling part and provided with projecting coupling web halves which are located on opposite sides of said notch and abut one another when said plate halves are in alignment with one another, said coupling web halves cooperate to form a coupling web, said hand gripping part having an opening in which said coupling web is engageable and said two plate halves further having portions thereof which are adapted to engage a groove formed in a second surface of said bristle support which is opposite said first surface.

2. A handbrush as defined in claim 1, wherein said bristles are formed on said bristle support and are thin and pointed.

3. A handbrush as defined in claim 1, wherein said coupling web halves each have an outer side provided with a first arresting formation, said opening having an inner surface provided with second arresting formations adapted to engage said first arresting formations when said coupling web is inserted in said opening.

4. A handbrush as defined in claim 3, wherein one of the first and second arresting formations is formed as an arresting groove, while the other of said first and second arresting formations is formed as an arresting projection.

5. As defined in claim 1, wherein said gripping part has a liquid-tight sealing formation which is adapted to engage a portion of said bristle support.

6. As defined in claim 5, wherein said sealing formation is formed as a sealing bead.

7. As defined in claim 1, wherein said bristle support has an edge web provided with a fluid-tight sealing formation adapted to engage a portion of said hand gripping part.

8. As defined in claim 7, wherein said sealing formation is formed as a sealing bead.

9. As defined in claim 1, wherein said hand gripping part has an elongated substantially spherical rear portion and gripping troughs on opposite sides of said hand gripping part and located between said rear portion and said bristle support.

* * * * *